United States Patent [19]

Rusbach

[11] 4,103,620

[45] Aug. 1, 1978

[54] PROJECTILE EXPLOSIVE

[75] Inventor: Maurice Rusbach, Vernier, Geneva, Switzerland

[73] Assignee: Sarmac S.A., Carouge, Geneva, Switzerland

[21] Appl. No.: 736,305

[22] Filed: Oct. 28, 1976

[30] Foreign Application Priority Data

Nov. 12, 1975 [CH] Switzerland ..... 14699/75

[51] Int. Cl.[2] ..... F42B 13/34

[52] U.S. Cl. .....102/38; 102/60

[58] Field of Search ..... 102/56, 60, 87, 38

[56] References Cited

U.S. PATENT DOCUMENTS

| | | | |
|---|---|---|---|
| 2,532,323 | 12/1950 | Miller, Jr. | 102/56 X |
| 2,848,947 | 8/1958 | Latham, Jr. | 102/60 X |

FOREIGN PATENT DOCUMENTS

| | | | |
|---|---|---|---|
| 84,321 | 9/1920 | Austria | 102/87 |
| 494,799 | 7/1953 | Canada | 102/60 |
| 414,005 | 7/1936 | United Kingdom | 102/56 |

*Primary Examiner*—Verlin R. Pendegrass

*Attorney, Agent, or Firm*—Young & Thompson

[57] ABSTRACT

The invention relates to an explosive fragmentation type projectile stabilized by gyration, carrying a tubular case and provided with an instantaneous percussion head fuse and a tracer.

The base of the projectile comprises a thick heavy and projecting central part, having at its rear end means of attaching a tracer, and an annular part of connecting the central part of the base to the cylindrical wall of the projectile having a thickness which diminishes in the direction of the central part.

This annular part of the base extends towards the rear of the projectile, and comprises at least one zone of diminished strength.

16 Claims, 9 Drawing Figures

PROJECTILE EXPLOSIVE

The present invention relates to an explosive fragmentation-type, gyration stabilised projectile comprising a percussion head fuse, launched by a light infantry support weapon.

In certain applications, particularly for projectiles of a calibre which may be as much as 50 mm, one may be motivated to employ a percussion head fuse of very simple design which may or need not have a detonator in addition to the charge, such a fuse being adapted to have a short arming distance, that is to say a muzzle security of only a few meters, which is unsufficient to ensure complete safety for the person using the weapon.

Furthermore, one may be compelled to limit the arming distance of the fuse in order to be able to use the weapon under close combat conditions where it is necessary for the projectile to operate at very short distances from the firing position.

It is then suitable for close range firing to take place without any danger to the user of the weapon.

Similarly, if the anti-personnel explosive projectile meets some unenvisaged obstacle at a short distance from the weapon and operates if its fuse is already armed, the user must likewise be protected against thrown back splinters of shell base.

The object of this invention is to provide an explosive projectile which although carrying a tracer, offers greater safety to the gunner and his ammunition server, enabling them not to be affected by any splinters which are thrown back in the event of the projectile exploding at a relatively close obstacle.

An object of the present invention is a fragmentation type explosive projectile which is stabilised by gyration, having a casing, provided with an instantaneous percussion head fuse and a tracer, characterised in that the base of the projectile comprises a thick heavy and projecting central portion having at its rear extremity tracer attachment means, and in that the annular part of the base linking this central part with the cylindrical wall of the projectile is of a medium thickness which steadily diminishes in the direction of this central portion.

The attached drawings show diagrammatically and by way of example two forms of embodiment of the projectile according to the invention. In the drawings.

Figure 1:
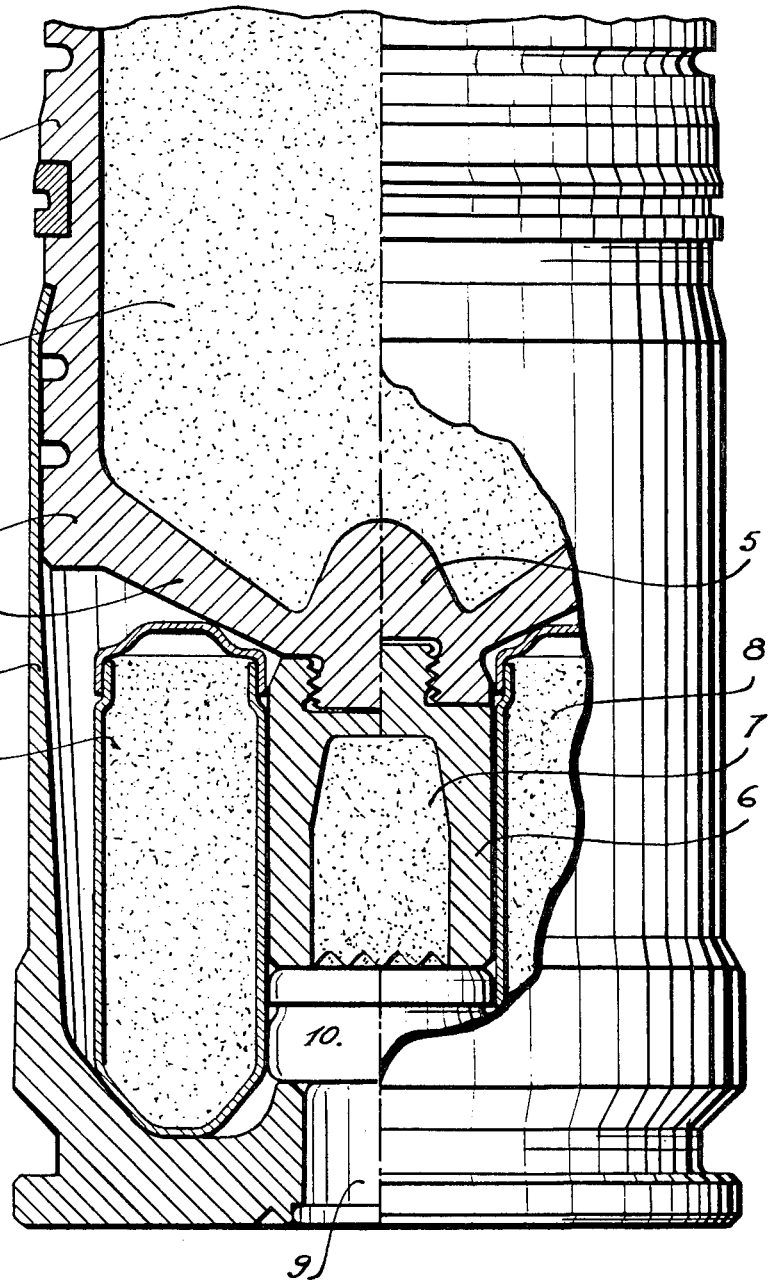
FIG. 1 illustrates a first form of embodiment and an alternative thereof.

A projectile which does not throw back splinters rearwardly over a certain angle may offer great interest to users of the launching weapon when the fuse does not have a considerable muzzle safety and when the projectiles involved are relatively small to allow direct firing at a sufficiently high initial velocity.

Indeed, a small individual gun launching an explosive projectile must allow the gunner to benefit from maximum firing safety and the shell base envisaged has in this case a certain advantage of usage. Even if the projectile functions at just a few meters from the gunner who, in the action of combat, may inadvertently touch some close obstacle with his shot, the explosion of the projectile will not affect him dangerously, since no splinter will be thrown back in his direction and the blast of the explosion will be too small in the free air to injure him.

In direct firing, and in positions where the weapon is aimed at ground level, certain shots may, during the first few meters of the trajectory, strike some unforeseen obstacle which may cause the projectile to explode and which, despite this operation, must not constitute any danger to the user of the weapon or to the ammunition server who may accompany him.

An initial projectile velocity of a few hundred meters per second will ensure that the tail cap which is the object of the invention has sufficient inertia for the blast of the explosion not to be strong enough to cancel it out entirely.

For a projectile which is launched for example at 400 m/sec., discharge of the tracer carrier may, according to its weight and the proportions given to the construction, correspond to a speed five to ten times less than the speed of any splinters emanating from the shell wall. For example, splinters may be thrown out at 2000 m/sec. and the tracer carrier cap only at 300 m/sec., avoiding its being thrown back towards the gunner. Furthermore, splinters from the walls are thrown outwards of the safety cone in which the gunner is located, so that he therefore has no reason to fear them.

This rear protective zone enables the gunner to be sheltered from any unforeseen operation of a projectile due to its striking an unexpected obstacle which is disposed beyond the safety distance provided by the arming lag. Thus, if the projectile strikes a branch, a clump of earth, an iron wire, etc., situated at a distance greater than the arming distance of the fuse, the projectile will explode but no base splinter will come back in the direction of the gunner. This arrangement offers an appreciable advantage for users.

The effects of the explosion of the projectile do not entirely annul the velocity of the tracer carrier, in other words 400 m/sec., the inertia of which is considerable. Therefore, this item is not thrown backwards but acts as an axial mask around which the showers of splinters are thrown in regular and symmetrical directions, the shape of the wall of the base helping to achieve this result.

The tracer carrier is mounted at the rear of the prepared fragmentation steel body, which is absolutely tight in respect of the propulsive gases.

The solution has the merit of being simple and of not giving rise to any losses in efficiency of the projectile. Therefore, the device enhances the qualities of the explosive without changing its characteristic features.

The fragmentation type explosive projectile shown in FIG. 1 has a cylindrical body 1 terminating at a base 2 on which there is mounted a tubular casing 3. The body 1 encloses the explosive charge 4 and has at its front end, not shown, a known type of head fuse.

The bottom 2*a* of the base 2 has a thick central portion 5 connected to the cylindrical wall of the body 1 by a wall, the thickness of which increases with increasing distance from this central part 5. This central part 5 comprises a part of a screw coupling, male in the left-hand part of FIG. 1 and female in the alternative embodiment shown in the right-hand half of FIG. 1, making it possible to couple a tracer carrier 6 enclosing a combustible powder 7 releasing rays of light as it burns, so that the gunner can follow the trajectory of his projectile.

Prior to the shot being fired, the tubular casing 3 encloses this tracer carrier 6 which is itself enclosed by the propulsive charge 8. This propulsive charge 8 is ignited when the shot is fired by the percussion of a primer 9 secured in the bottom of the tubular casing 3 and a detonator 10 ensuring simultaneous firing of the tracer 7.

The interest of such a fragmentation type explosive projectile resides in the design of its base 2, to which the tracer carrier 5 is secured.

Figure 8:
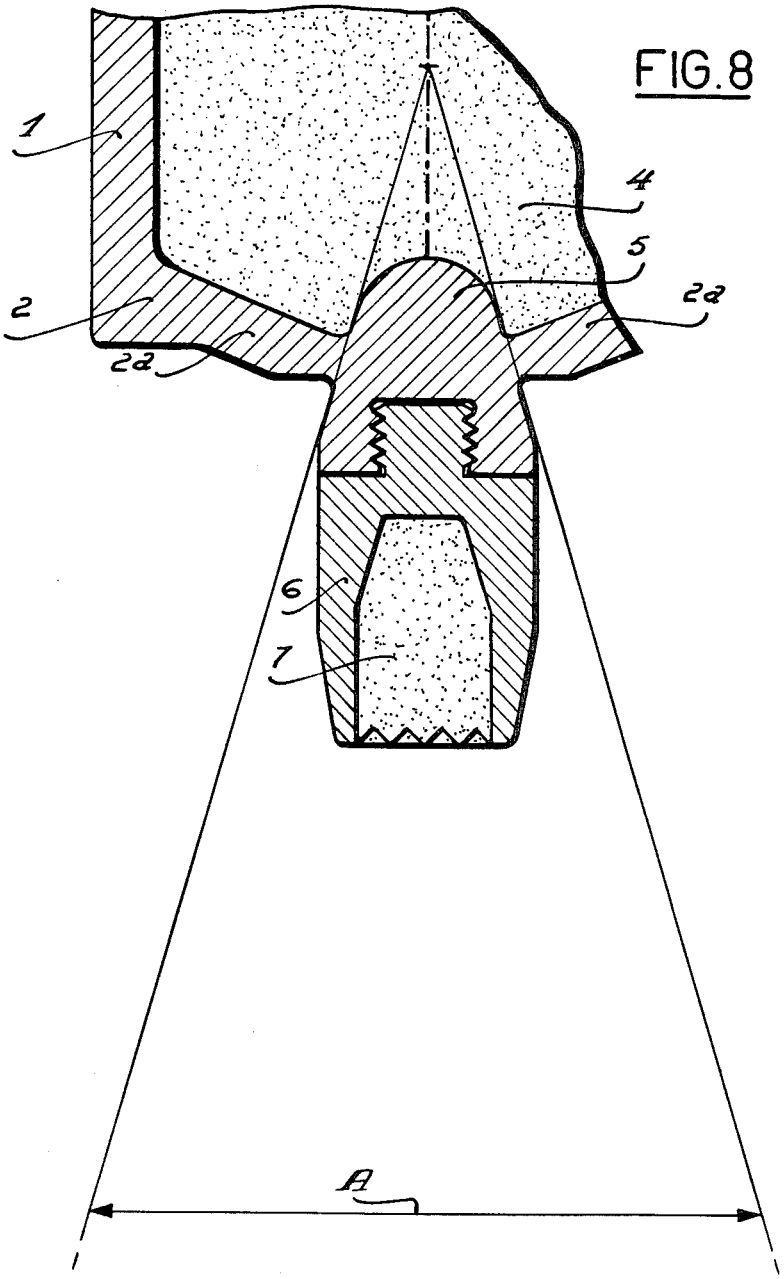
FIG. 8 illustrates diagrammatically the dead zone of such a projectile.

The tracer carrier situated axially in extension of the body of the projectile and at the rear of the base, does not become fragmented at the moment of explosion but remains as a single piece. Breakage of the metal which forms the link between the base and the tracer carrier occurs at an oblique angle, by virtue of the generally convex form of the base, the diminishing thickness of the metal and weakened points provided at appropriate locations. The explosive charge, the convex form of which corresponds to that of the inner wall of the base disperses this into splinters symmetrically in respect of the axis of the projectile, leaving a "dead" zone (FIG. 8), that is to say a conical zone A located behind the projectile in which no splinters occur, only the tracer carrier remaining in the axis of this zone. The wall of the base becomes thinner towards the smallest diameters before reaching the tracer carrier which constitutes a strong central element serving as an axial core which is hardly suitable for being thrown at high speed by the effects of the explosion. The general structure, shapes and proportions of the construction make it possible to produce a projectile which has the qualities indicated.

Thus, the base may comprise a central swelling which is directed towards the front of the projectile. This convex swelling is not destroyed by the explosion. It allows the gases to slide over it and it remains attached to the tracer carrier. The whole assembly is somewhat reminiscent of a small relatively dense projectile following the larger one.

According to the amount of the safety angle which it is desired to obtain, so the shape of the base may be varied. Thus, the more inclined are the walls of the base, the more open the safety cone will be.

It should be noted that the tracer carrier has a relatively thick bottom in order to avoid its becoming indented under the action of the explosion on impact. Thus, small splinters cannot be thrown through the rear recess in the tracer carrier which contains the luminous active material.

Generally speaking, the original characteristics of this projectile reside in the fact that the central part of the base, carrying the tracer, is of such a weight in respect of its cross-section that at the time of the explosion which separates this heavy part from the body of the projectile, its inertia is such that the force of the explosion of the projectile is not sufficient to cancel out its forward speed. Thus, at the time of the explosion, the central part of the base is decelerated, nay even stopped, but is never thrown towards the rear. This part forms a protective screen for the gunner in the event of premature explosion of the projectile on its trajectory. The weight of the central part 5 of the base and of the tracer carrier is of the order of 2 to 10 grams and the velocity with which it is thrown by the explosion of the projectile is of the order of 5 to 10 times less the speed of the splinters. For a 24 mm calibre, the central part 5 and the tracer carrier preferably have a total weight of 3 to 5 grams.

In the forms of embodiment to be described hereinafter, the same reference numerals have at all times been used to designate similar elements. Only the substantial differences which these new forms of embodiment exhibit in respect of the first will be described, the remainder of the projectile being approximately identical.

Figure 2:
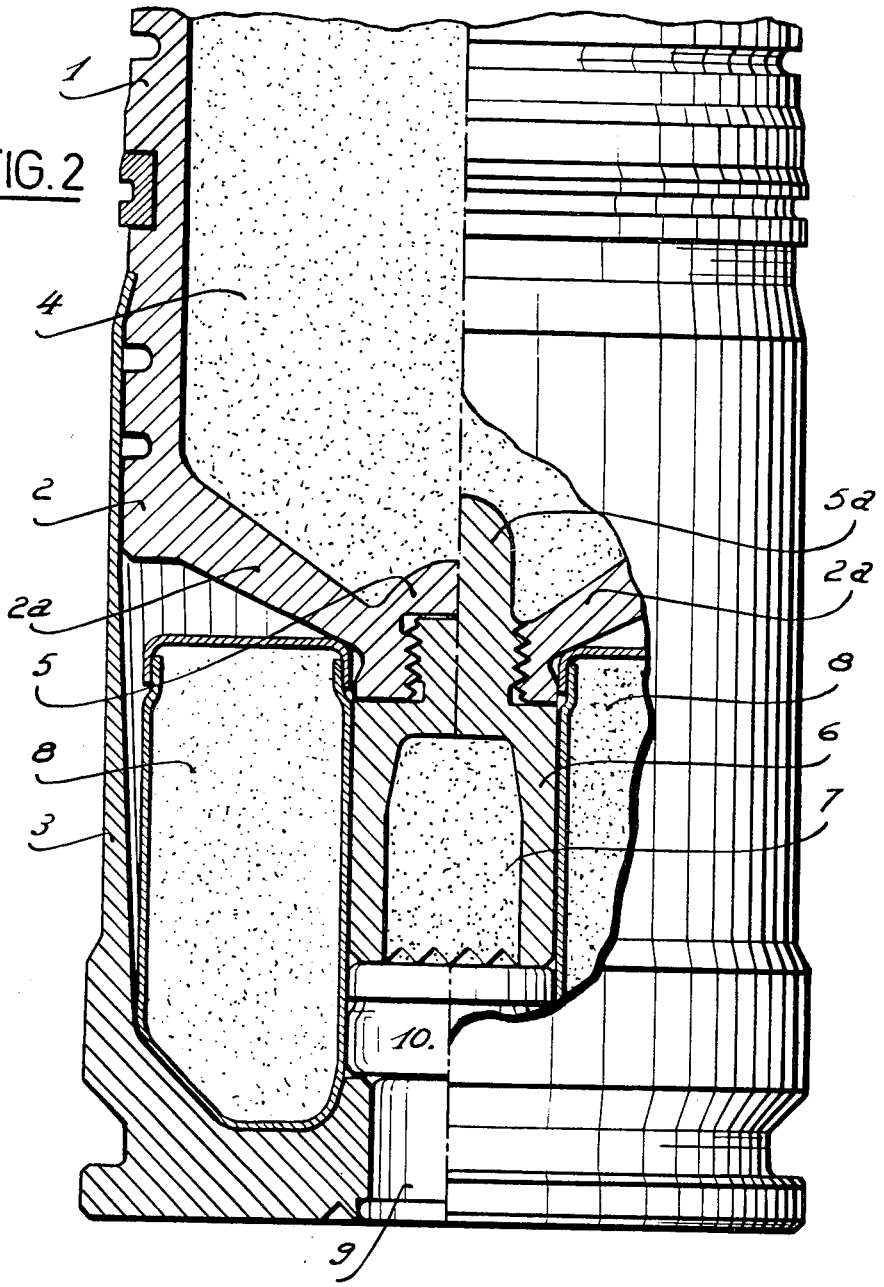
FIG. 2 illustrates a second form of embodiment and an alternative thereof.

FIG. 2 illustrates a projectile of which the tubular casing 3 is less long and the propulsive charge 8 is more compact.

The left-hand part of this FIG. 2 illustrates a central part 5 of the base which is less convex at the front.

In the alternative illustrated in the right-hand part of the said FIG. 2, the central part of the base is formed by an extension 5*a* of the tracer carrier 6 which is screwed into the bottom 2*a* of the base 2.

Figure 3:
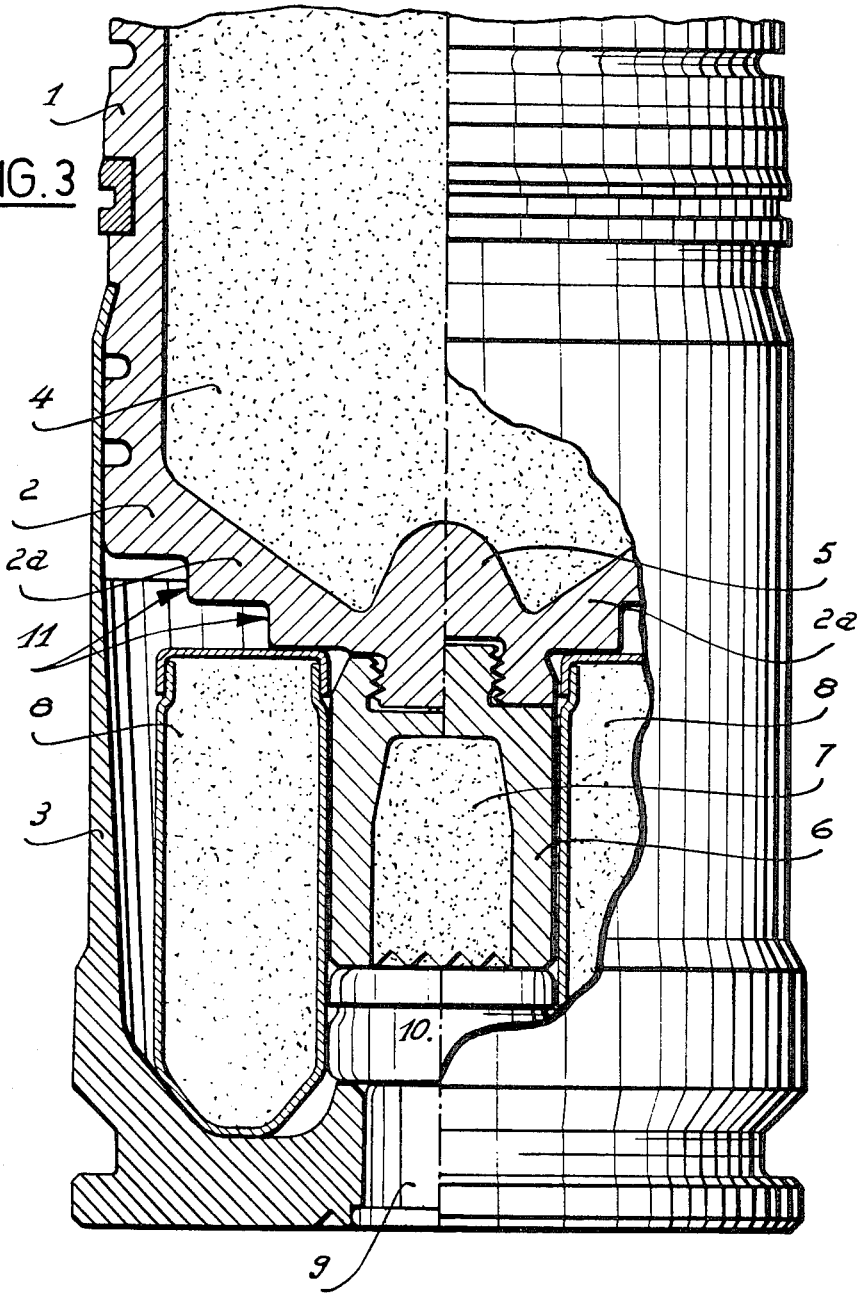
FIG. 3 illustrates a third form of embodiment and an alternative thereof.

In the two alternative embodiments illustrated in FIG. 3, the bottom 2*a* of the base 2 connecting the cylindrical wall of the body 1 to the central part 5 of the base is stepped so as to form weakened breakage zones 11. Upon explosion of the projectile, the bottom of the base becomes broken along the zones 11 and by reason of the disposition of the explosive charge 4, these splinters are thrown in such a way that they travel away from the longitudinal axis of the projectile.

Figure 4:
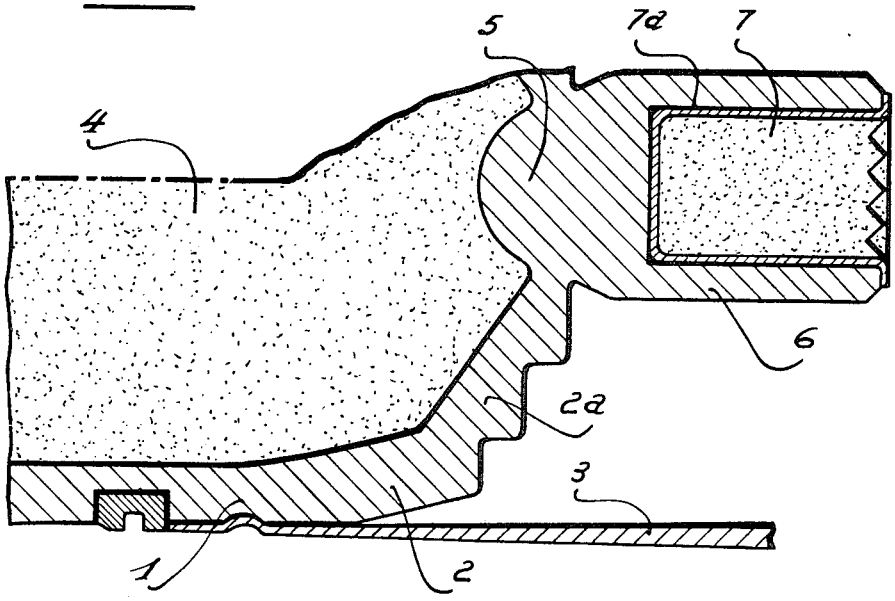
FIGS. 4 and 5 illustrate two other forms of embodiment of the projectile.

In the form of embodiment illustrated in FIG. 4, the tracer carrier 6 is made in one piece with the base and therefore the body 1 of the projectile. The charge 7 of the tracer is at least partially encapsulated in a casing 7*a* which may be forced into the tracer carrier 6.

Figure 5:
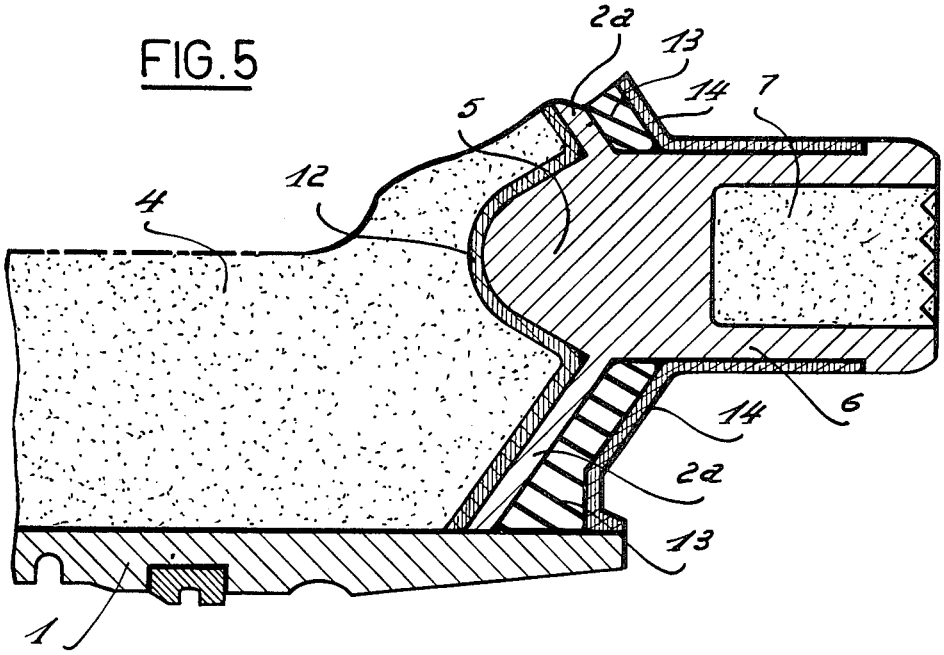

In the form of embodiment shown in FIG. 5, the base is shrunk into the rear end of the body 1 and is rigid with the tracer carrier 6. The explosive charge is separated from the base by a piece of cardboard 12. An annular ring made from an elastic material 13 is disposed behind the bottom 2*a* of the base and is held in position by means of a member 14 banded around the tracer carrier 6 and in the end of the body 1. In this form of embodiment, the base constitutes a piston which compresses the explosive charge when the propulsive charge is fired.

Figure 6:
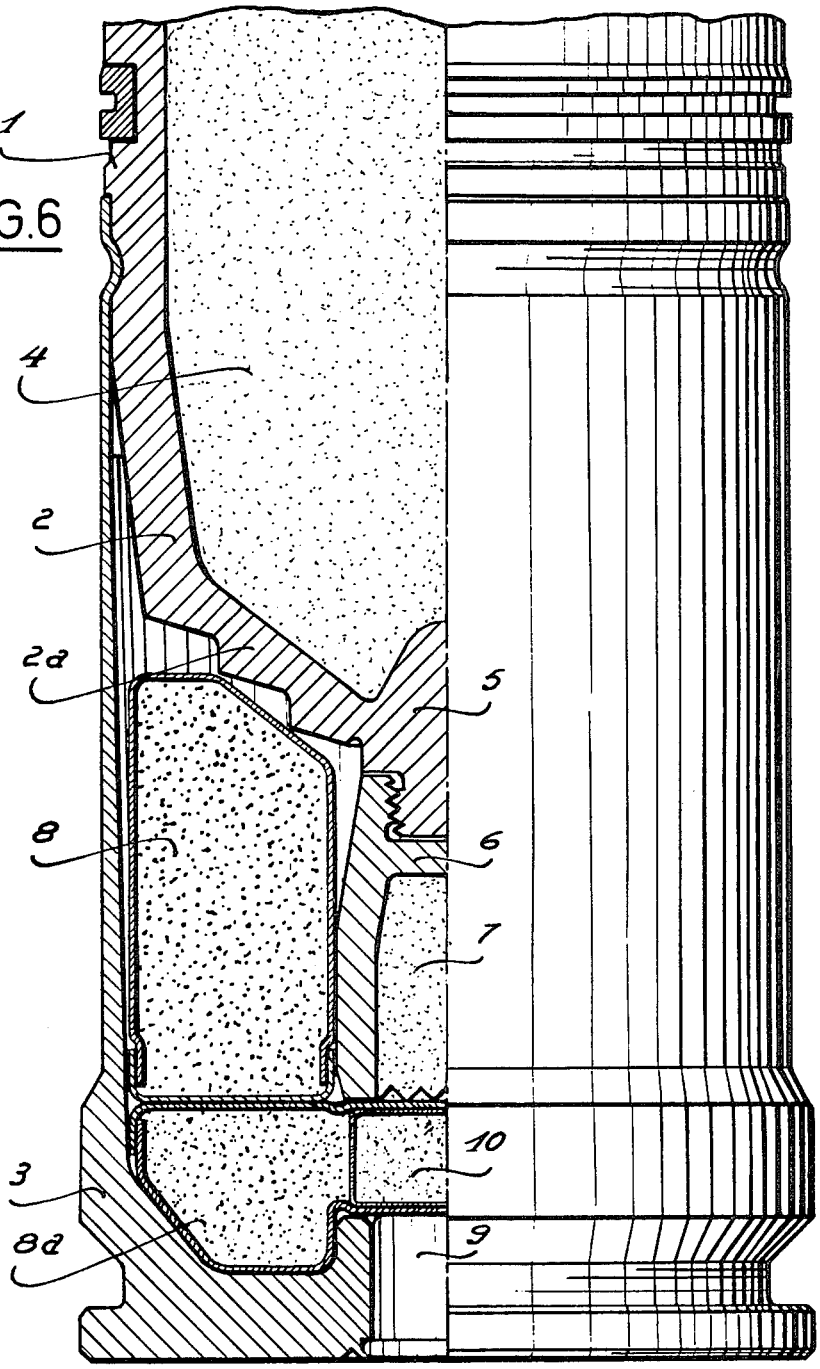
FIGS. 6, 7 and 9 illustrate two further forms of embodiment of the projectile.

FIG. 6 illustrates an alternative embodiment in which the propulsive charge is divided into two cakes 8 and 8*a*. In this embodiment, the front part of the tracer carrier 6 is in the form of a truncated cone.

Figure 7:
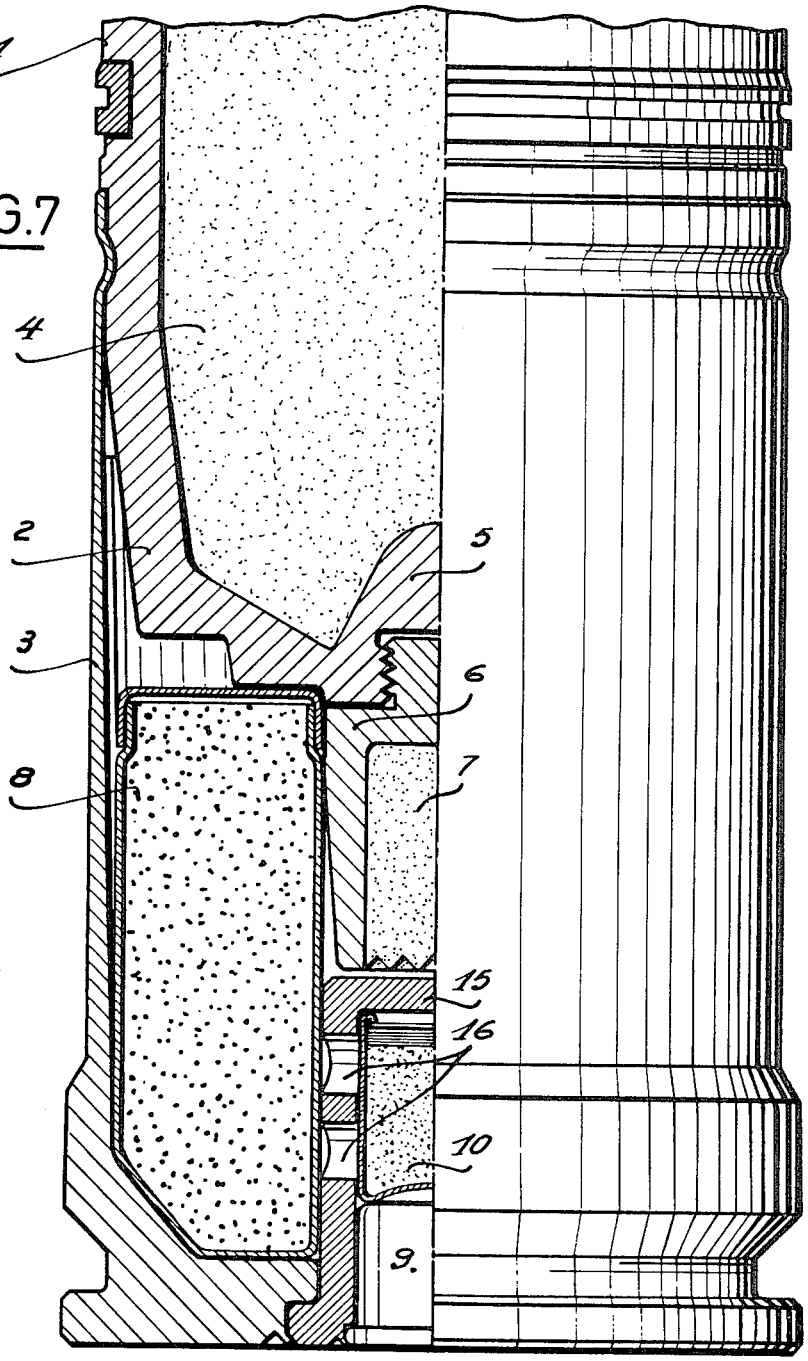

In the form of embodiment shown in FIG. 7, the detonator 10 is housed with the capsule 9 in a sheath 15 having ports 16 to allow firing of the propulsive charge.

It should be noted that in almost all the forms of embodiment, the explosive charge 4 has at its rear end an axial cavity or recess encouraging radial fracture of the bottom wall of the base.

The conical shape of the bottom of the base is likewise an element which permits of radial breakage of this latter upon explosion of the projectile.

The central part of the base or the frontal projection of the tracer carrier, generally fill all or part of the axial cavity of the explosive charge.

It is obvious that amny other structural modifications based on the principle described may be envisaged, all of which will result in an identical functioning of the projectile and which allow realisation of the intended object, that is to say the creation of a safety cone at the rear of the projectile.

Generally speaking, it may be said that the problem may be resolved preferably by connecting the tracer carrier to the projectile by a base wall of which the general shape is projecting and biased. It is advisable for this wall to have a degressive shape with increasing proximity to the tracer carrier, to facilitate its opening at the level of this latter when the explosion occurs.

Figure 9:
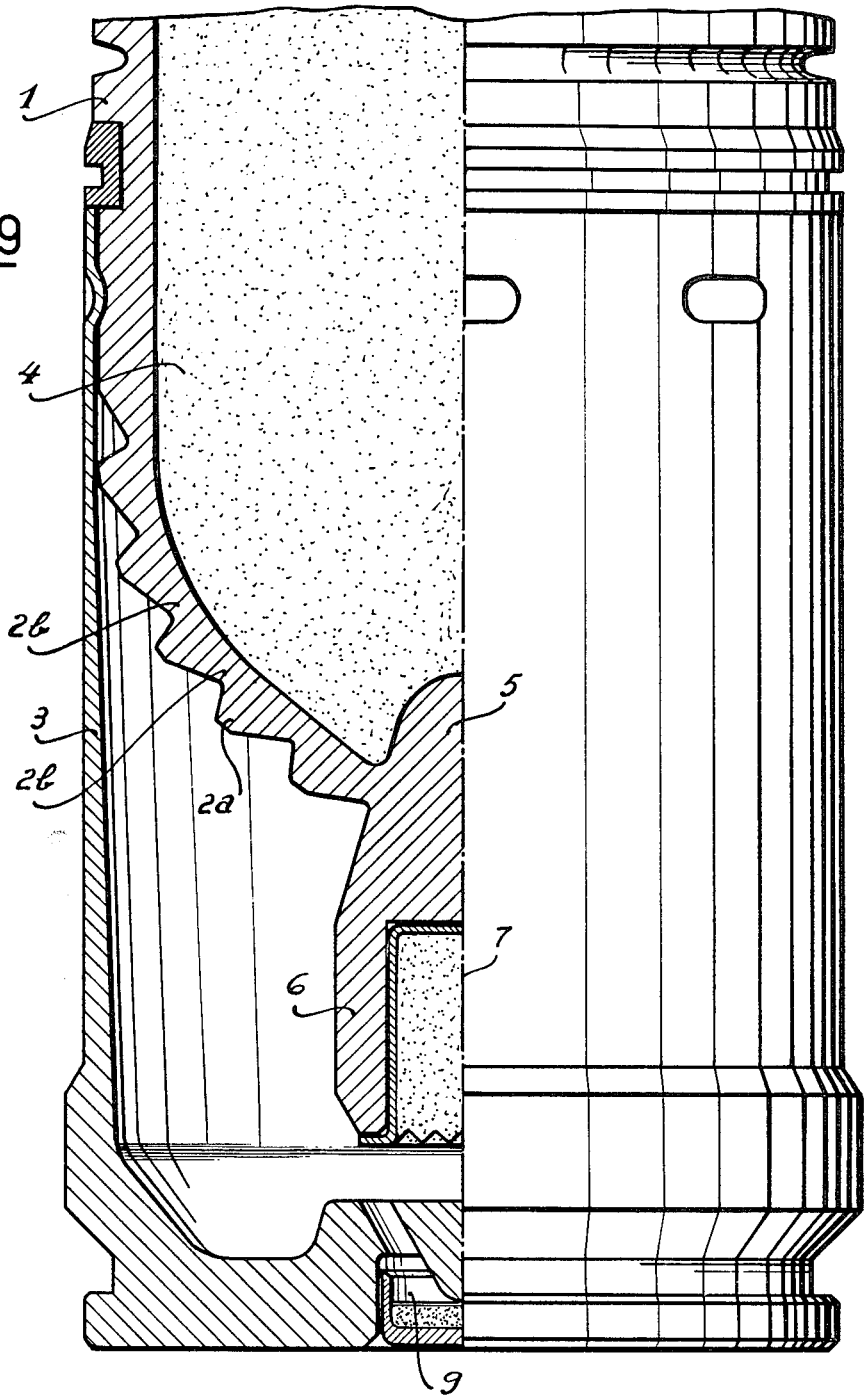

In a final alternative embodiment shown in FIG. 9, the central part of the base carrying the tracer holder 6 is likewise thick and heavy and has a protuberance 5 extending into a hollow in the explosive charge.

In this alternative embodiment, the bottom 2*a* of the base is of generally arcuate hollow form and its average thickness diminishes in the direction of the tracer carrier 6. This bottom 2*a* of the base has a variable thickness so constituting weakened zones 2*b* facilitating bursting or radial opening of this bottom upon explosion of the charge 4. Here, again, the relatively considerable mass of the tracer carrier 5, 6 makes it possible to form a safety zone by providing a screen. The particular shape of the bottom of the base, facilitating radial bursting, likewise contributes to the creation of this safety zone.

The design has the following advantages:

1. Simplicity of construction; no additional parts.
2. A conical "safety zone", limited to a logical angle, the rest of the space surrounding the projectile retaining excellent efficacy.
3. The judicious use of all the walls of the projectile so that splinters thrown out in a multitude are well distributed, the base not representing the cause of any loss in efficiency whatsoever.

It can thus be seen that the general form given to the projectile ensures its having a very high degree of efficiency.

We claim:

1. An explosive fragmentation type projectile stabilised by gyration, carrying a tubular case and provided with an instantaneous percussion head fuse and a tracer, in which the base of the projectile comprises a thick heavy and projecting central part, having at its rear end means of attaching a tracer and in which an annular part of the base connecting the central part to a cylindrical wall of the projectile is of a thickness which diminishes in the direction of the central part, and which extends towards the rear of the projectile, and in which this annular part of the base comprises at least one zone of diminished strength.

2. A projectile according to claim 1, in which the weight of the thick central part of the base and of tracer carrier which it carries is such that the velocity of this assembly is not cancelled out by the explosion of the projectile.

3. A projectile according to claim 1, in which an explosive charge occupies an axial recess at its rear end.

4. A projectile according to claim 1, in which a propulsive charge is housed in the tubular casing around a tracer carrier.

5. A projectile according to claim 4, in which the bottom of the base is of a variable and continuously decreasing thickness.

6. A projectile according to claim 4, in which the bottom of the base has a stepped wall providing a plurality of breakage zones of diminished thickness.

7. A projectile according to claim 4, in which the tracer carrier is screwed onto the central part of the base.

8. A projectile according to claim 4, in which the tracer carrier is in one piece with the central part of the base.

9. A projectile according to claim 4, in which the base is manufactured in one piece with the body of the projectile.

10. A projectile according to claim 4, in which the base is shrunk into the body of the projectile and constitutes a piston compressing the explosive charge when the propulsive charge is fired.

11. A projectile according to claim 4, in which the outer wall of the tracer carrier is cylindrical.

12. A projectile according to claim 4, in which the outer wall of the tracer carrier comprises at least one conical portion.

13. A projectile according to claim 3, in which the central part of the base has a protuberance filling at least part of a cavity in the explosive charge.

14.A projectile according to claim 4, in which the tracer carrier comprises a frontal protuberance filling at least a part of a cavity in an explosive charge in the rear end of the projectile.

15. A projectile according to claim 4, in which the base has a bottom of generally conical form.

16. A projectile according to claim 4, in which the base has a bottom of generally convex form.

* * * * *